US008316556B2

(12) United States Patent
Beurel et al.

(10) Patent No.: US 8,316,556 B2
(45) Date of Patent: Nov. 27, 2012

(54) ZEOLITE DEHYDRATION UNIT

(75) Inventors: Gilles Beurel, Cergy (FR); Dominique Boutaud, Orleans (FR)

(73) Assignee: Millerail, Orleans (FR)

( * ) Notice: Subject to any disclaimer, the term of this patent is extended or adjusted under 35 U.S.C. 154(b) by 223 days.

(21) Appl. No.: 12/747,661

(22) PCT Filed: Dec. 11, 2008

(86) PCT No.: PCT/FR2008/001723

§ 371 (c)(1),
(2), (4) Date: Jun. 11, 2010

(87) PCT Pub. No.: WO2009/101302

PCT Pub. Date: Aug. 20, 2009

(65) Prior Publication Data

US 2010/0263222 A1 Oct. 21, 2010

(30) Foreign Application Priority Data

Dec. 19, 2007 (FR) ..... 07 08906

(51) Int. Cl.
*F26B 13/30* (2006.01)
*F26B 25/18* (2006.01)

(52) U.S. Cl. ..... 34/92; 34/80; 34/239; 34/242

(58) Field of Classification Search ..... 34/92, 239, 34/242, 417, 80
See application file for complete search history.

(56) References Cited

U.S. PATENT DOCUMENTS

| | | | | |
|---|---|---|---|---|
| 2,317,882 | A | 4/1943 | Boesel | |
| 2,487,620 | A | 11/1949 | Waller | |
| 2,671,526 | A * | 3/1954 | Hunt et al. | 96/117.5 |
| 2,676,078 | A | 4/1954 | Young | |
| 3,010,600 | A | 11/1961 | Larsen | |
| 3,192,645 | A | 7/1965 | Oetjen | |
| 4,146,277 | A | 3/1979 | Santoro | |
| 4,498,608 | A | 2/1985 | Mercil | |
| 4,777,021 | A * | 10/1988 | Wertz et al. | 422/534 |
| 5,813,564 | A | 9/1998 | Luo | |
| 2003/0196687 | A1 | 10/2003 | Campbell et al. | |

FOREIGN PATENT DOCUMENTS

| | | | |
|---|---|---|---|
| DE | 10 2004 049349 | A1 | 4/2006 |
| EP | 0 283 060 | A | 9/1988 |
| FR | 2 868 520 | A | 10/2005 |
| FR | 2868520 | A1 * | 10/2005 |
| FR | 2 927 408 | A | 8/2009 |
| GB | 239 047 | A | 9/1925 |

* cited by examiner

*Primary Examiner* — Jiping Lu
(74) *Attorney, Agent, or Firm* — Muncy, Geissler, Olds & Lowe, PLLC

(57) ABSTRACT

An installation for dehydrating products, the installation having an enclosure, a member for sucking out the air contained in the enclosure, and a container for products that is received inside the enclosure and that is provided with a top opening having an air- and water-permeable bottom of a cassette extending in register therewith. The cassette contains zeolites. A sealing gasket extends between a perimeter of the bottom of the cassette and an edge of the container, defining the opening.

12 Claims, 4 Drawing Sheets

ZEOLITE DEHYDRATION UNIT

The present invention relates to a dehydration installation making use more particularly of zeolites as adsorption means. The invention is intended more particularly for dehydrating food products having organoleptic qualities that need to be conserved.

BACKGROUND OF THE INVENTION

It is recalled that a zeolite is a material having pores of a diameter that is greater than the smallest dimension of a water molecule and having electric charge that attracts water molecules. These characteristics confer on zeolite the power to adsorb water in a manner that is advantageous in the field of dehydration.

Dehydration by means of zeolites, or "zeodration", is generally performed by means of an installation having a first enclosure and a nearby second enclosure in communication therewith. The first enclosure is arranged to receive products for dehydrating and the second enclosure receives zeolites and is fitted with a pump for sucking out the air contained in the enclosures. The suction pump establishes low pressure in the enclosures that encourages the water contained in the products to evaporate, which products are possibly heated. The water vapor passes into the second enclosure where it is trapped in the zeolites. That type of dehydration is particularly effective.

Nevertheless, a fraction of the aromas are nevertheless extracted from the products. These aromas are to be found in the second enclosure prior to being evacuated by the pump. This spoils the organoleptic qualities of the dehydrated products.

Proposals have been made for an installation for dehydrating products, in particular food products, that is effective while nevertheless minimizing harm to the qualities of the products, and in particular the organoleptic properties for food products.

One such installation, described in document FR-A-2 868 520 comprises an enclosure, a member for sucking out the air contained in the enclosure, a product container that is received inside the enclosure and that is provided with a top opening, an air- and water-permeable bottom of a cassette extending in register therewith, the cassette containing moisture-adsorption means. The cassette overlies the container and cooperates therewith to define a compartment from which air is sucked out through the adsorption means, thereby keeping the aromas that escape during the evaporation of the water contained in the products in the neighborhood of those products.

The performance of those installations is quite remarkable and it might seem impossible to improve it.

OBJECT OF THE INVENTION

Nevertheless, the present invention seeks to achieve such an improvement.

SUMMARY OF THE INVENTION

The invention thus provides an installation for dehydrating products, the installation comprising an enclosure, a member for sucking out the air contained in the enclosure, a container for products that is received inside the enclosure and that is provided with a top opening having an air- and water-permeable bottom of a cassette extending in register therewith, the cassette containing moisture-adsorption means, a sealing gasket extending between a perimeter of the bottom of the cassette and an edge of the container defining the opening.

The sealing gasket prevents air from passing between the cassette and the container. It has been found that a fraction of the aromas can escape by following such a passage and even if this fraction is small, such a loss of aromas is perceptible to the taste.

Advantageously, the sealing gasket is secured to a removable frame having surfaces for positioning it laterally on the container and/or the cassette with, preferably, a bottom peripheral rim to which the lateral positioning surfaces belong and/or a top peripheral rim to which the lateral positioning surfaces belong.

It is thus easy to handle the gasket for cleaning purposes, while limiting the risk of damaging it. The positioning means guarantee that the sealing gasket is in the proper position for performing its function.

Preferably, the sealing gasket is made of a thermally-insulating material.

The sealing gasket then serves to isolate the heater means from the cassette by limiting heat transfer by conduction from the cassette to the container. A temperature difference between the cassette and the products contained in the container enhances condensation of aromas.

According to particular characteristics:

- the installation comprises means for moving the cassette and the container relative to each other between a contact position where the sealing gasket is in contact with both the cassette and the edge of the container, and a separation position where the sealing gasket is separated from the cassette and/or the edge of the container;
- the enclosure contains at least one shelf, the container and the cassette have lateral portions received in slideways of a support, the cassette being suspended under a top flange of the slideways and the container being movable between the contact position and the separation position in which the lateral portions of the container rest on bottom flanges of the slideways, the support being movable between a high position in which the container is separated from the shelf and rests via its lateral portions on the bottom flanges of the slideways, and a low position in which the container rests on the shelf and is in the contact position relative to the cassette;
- the lateral portions of the cassette are suspended from the top flanges of the slideways by a resilient member;
- the support is suspended from a substantially horizontal top rail connected to a ceiling of the enclosure via at least one vertical movement member for moving the top rail between the high position and the low position;
- the shelf is associated with heater means;
- the enclosure contains a plurality of superposed shelves and the support is fitted with a plurality of superposed slideways; and preferably, the support includes a central strength member having a top end secured to a carriage slidable along the top rail, the slideways extending laterally, projecting from two mutually-opposite faces of the central strength member that are substantially parallel to the top rail, the shelves being disposed in two groups placed facing each other on opposite sides of a path for passing the central strength member of the support; the central strength member of the support advantageously having a bottom end arranged to co-operate with a bottom rail fastened in the enclosure parallel to the top rail.

Other characteristics and advantages of the invention appear on reading the following description of a particular, non-limiting embodiment of the invention.

BRIEF DESCRIPTION OF THE DRAWINGS

Reference is made to the accompanying drawings, in which.

DETAILED DESCRIPTION OF THE INVENTION

With reference to the figures, the installation in accordance with the invention comprises an enclosure given overall reference 1 that is defined in this example by a blind tubular wall 2 having an open end that is closed in leaktight manner by a door 3.

The enclosure 1 is associated with an evacuation member shown diagrammatically at 4 that comprises in conventional manner a pump for sucking out the air contained in the enclosure 1.

Figure 6:
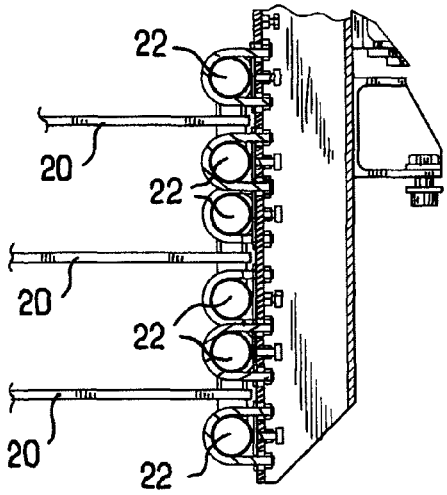
FIG. 6 is a detail view of zone VI of FIG. 1.
Figure 7:
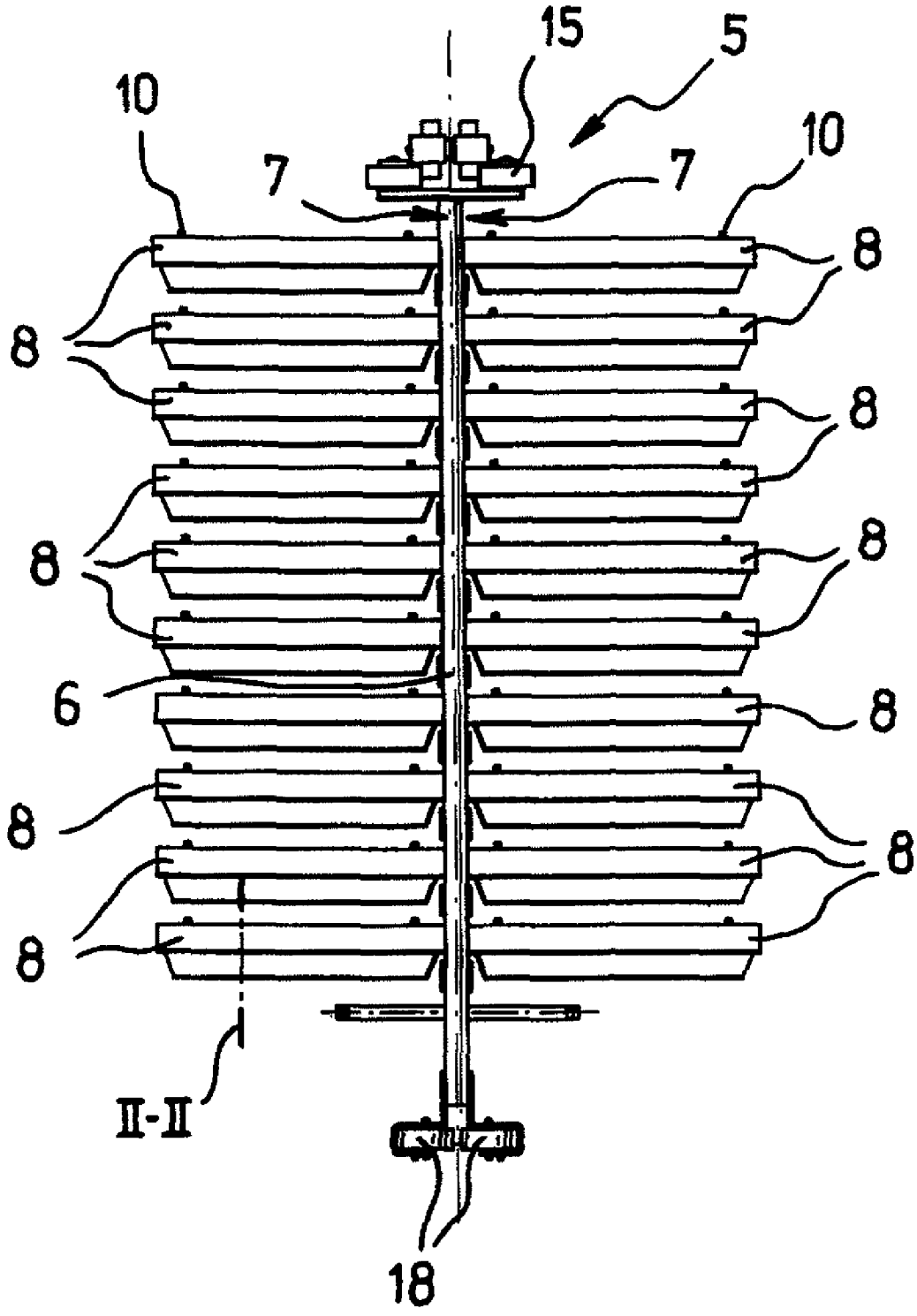
FIG. 7 is an elevation view of the support module for the containers or the cassettes.

Horizontal and superposed shelves 20 are fastened inside the enclosure 1, the shelves being organized as two separate groups spaced apart by a passage 21 that extends along the central axis of the enclosure 1. The shelves 20 are made of thermally-conductive material, in this example stainless steel or aluminum, and each has an edge remote from the passage 21 that is fastened to a pipe 22 for conveying a heat transfer fluid (FIG. 6). The pipes 22 are substantially horizontal and they are connected to one another by manifold pipes 23 to form a circuit that is connected to a device 24 for heating and circulating the heat transfer fluid, which device is located outside the enclosure 1.

Figure 1:
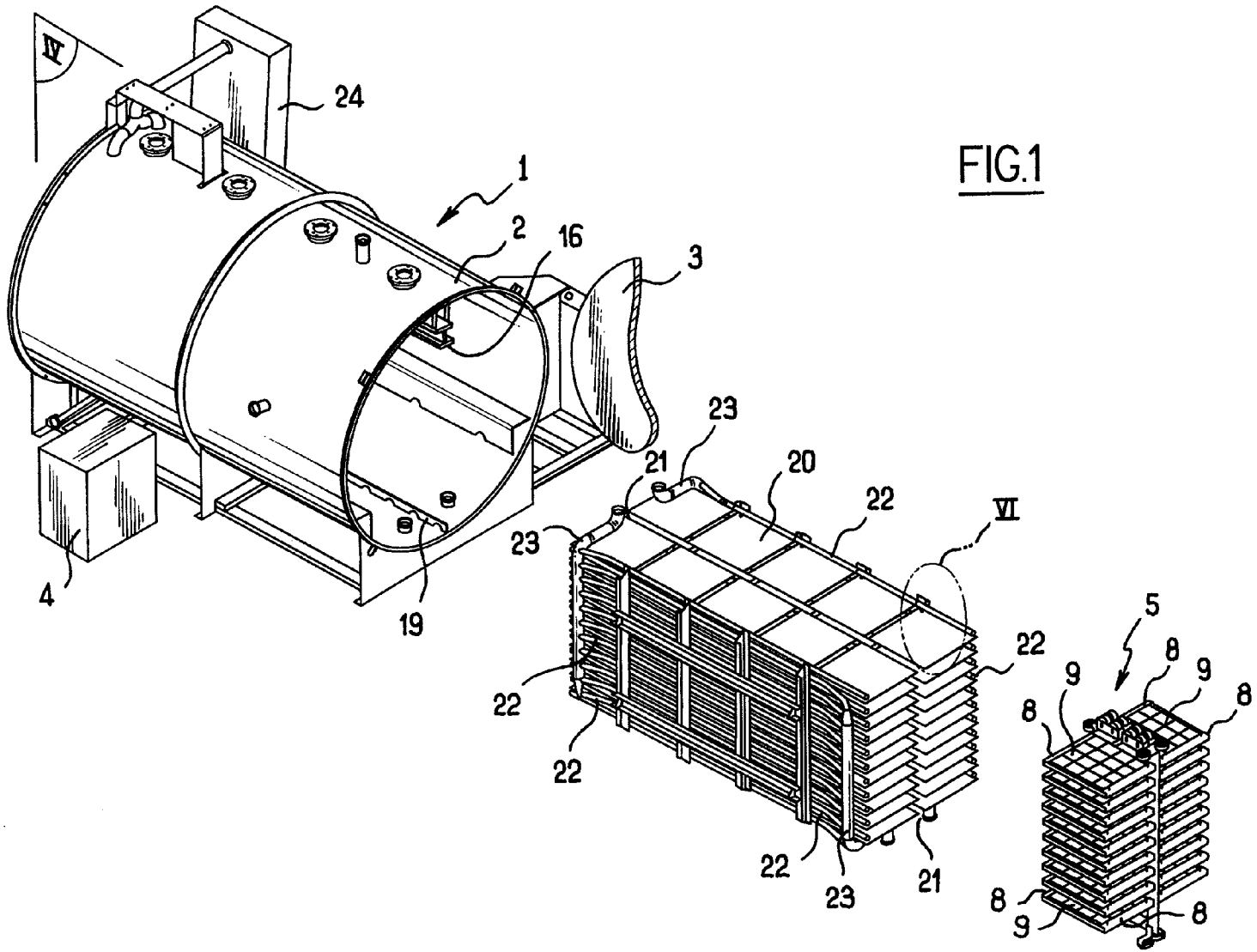
FIG. 1 is an exploded perspective view of an installation in accordance with the invention.
Figure 2:
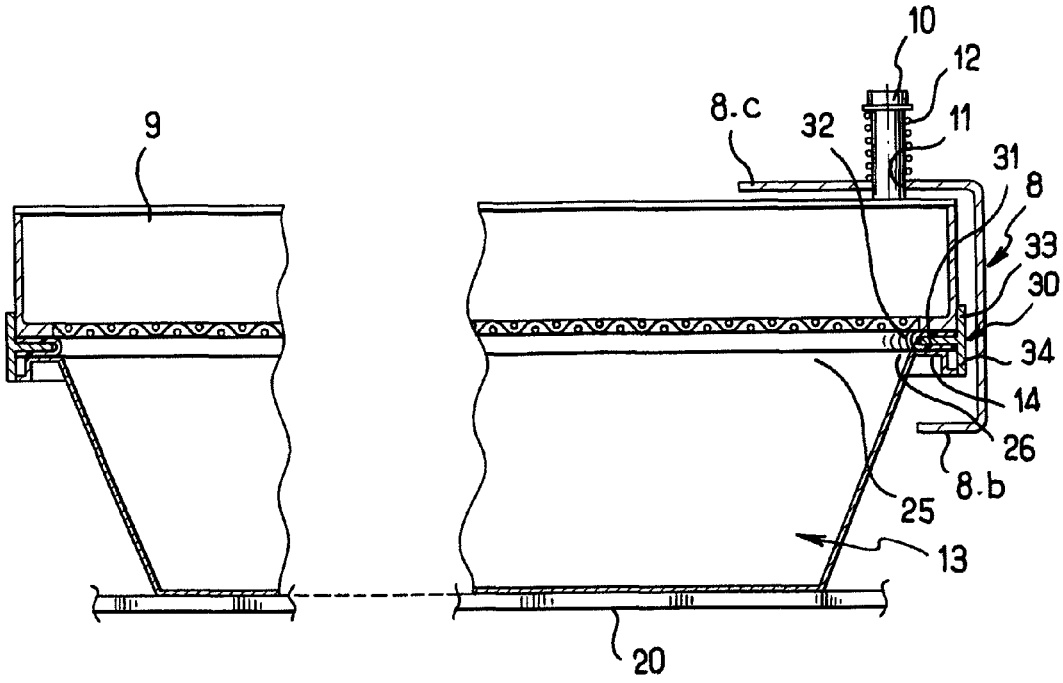
FIG. 2 is a fragmentary view in section on line II-II of FIG. 7, showing a container/cassette assembly in the contact position.
Figure 3:
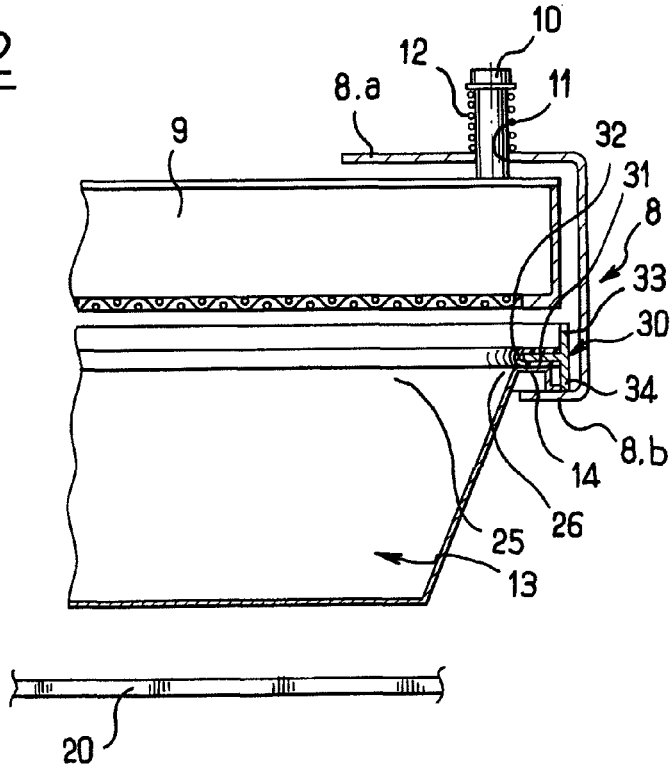
FIG. 3 is a fragmentary view of said assembly in the separation position.
Figure 4:
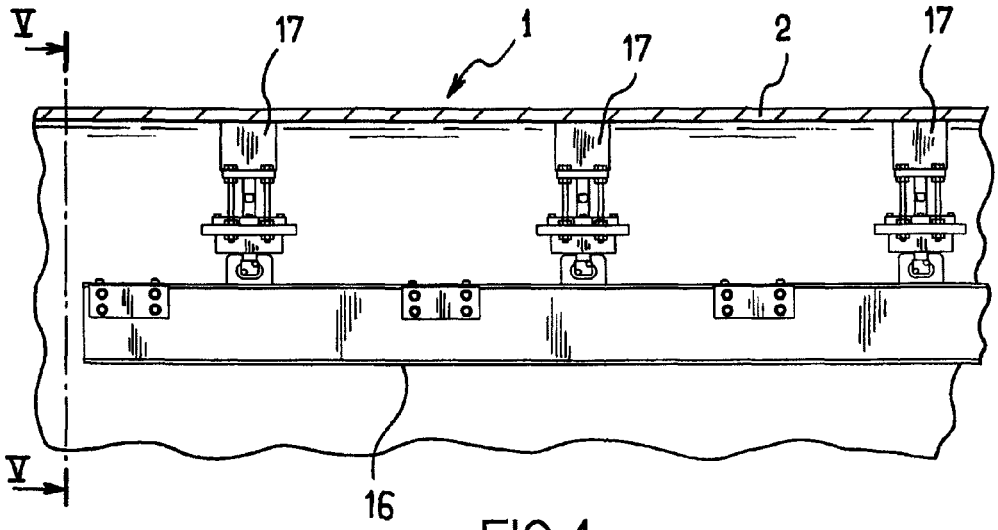
FIG. 4 is a fragmentary view of the installation in section plane IV of FIG. 1.
Figure 5:
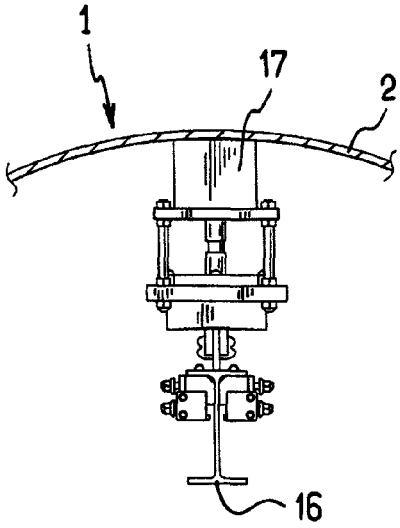
FIG. 5 is a section view on line V-V of FIG. 4.

A module, given overall reference 5, for supporting both products for dehydrating and zeolites is received inside the enclosure 1. The support module 5 comprises a central strength member 6 having two opposite faces 7 from which pairs of horizontal slideways 8 project laterally, each having a C-shaped section with a top flange 8.*a* and a bottom flange 8.*b* (only one slideway is shown in FIGS. 2 and 3).

Each pair of slideways 8 receives a zeolite cassette 9. Each cassette 9 comprises a bottom and a top wall with side walls extending between them over a height that is less than the distance between the flanges 8.*a* and 8.*b* of the slideways 8 between which the cassette 9 is received. More precisely, each cassette 9 has two opposite edges suspended under the top flanges 8.*a*, 8.*b* of the corresponding pair of slideways 8. For this purpose, pegs 10 extend from these projecting edges above the top wall of the cassette 9 by passing through openings 11 formed in the top flanges 8.*a*. Each peg 10 has a shouldered head and a helical spring 12 extending around the peg 10 between the shouldered head and the flange 8.*a*.

The cassettes 9 receive zeolites (not shown). The top portions and the bottoms of the cassettes 9 are constituted by grids (the bottoms being shown symbolically in FIGS. 2 and 3), of a mesh size that retains the zeolites while allowing air to pass through. The bottom-forming grids have a mesh that allows water vapor to pass through.

Each pair of slideways 8 slidably receives a container 13 for containing products.

Each container 13 comprises a bottom and low side walls and presents a top opening 25 defined by an edge 26. Two of the side walls, opposite each other, are provided remote from the bottom with respective outwardly-projecting rims 14. Each rim 14 lies between the bottom flange 8.*b* and the corresponding cassette 9 in such a manner that the container 13 extends under the cassette 9 and is movable vertically between two positions, as explained below.

Each assembly comprising a cassette 9 and a container 13 presents a height that is less than the distance between two shelves 20.

The central strength member 6 of the module 5 has a top end secured to a carriage 15 that is suspended from a top rail 16 parallel to the central axis of the enclosure 1 and connected to the ceiling of the enclosure 1 by actuators 17 that are connected to a control unit (not shown in the figures) that is arranged to cause the actuators 17 to move the rail 16 vertically between a high position and a low position.

The central strength member 6 of the module 5 possesses a bottom end provided with wheels 18, presenting vertical axes and suitable for running on two opposite faces of a bottom rail 19 fastened in the bottom portion of the enclosure 1 parallel to the top rail 16 for the purpose of guiding the bottom end of the central strength member 6 of the module 5 laterally so as to prevent it from swinging in the enclosure 1.

A gasket-carrier frame 30 is removably received on each container 13. The gasket-carrier frame 30 comprises a horizontal core 31 of shape that corresponds to the shape of the top opening 25 of the container 13. A sealing gasket 32 of thermally-insulating material, such as a silicone elastomer, is engaged around the inner periphery of the core 31. From the outer periphery of the core 31 there extend, projecting respectively upwards and downwards, both a top rim 33 and a bottom rim 34 that form surfaces for laterally positioning the gasket-carrier frame 30 relative both to the cassette 9 and to the rim 14 of the container 13.

The container 13 on which the gasket-carrier frame 30 rests via the sealing gasket 32 is movable vertically in the slideways 8 between a (high) contact position where it is in contact with the sealing gasket 32 with the cassette 9, and with the edge 26 (FIG. 2), and a (low) separation position, where it is separated from the sealing gasket 32 and the cassette 9, with the container then resting via its edges 14 on the bottom flanges 8.*b* of the slideways 8 (FIG. 3).

The operation of the installation is described below.

The containers 13 are filled with products for dehydrating outside the enclosure 1 in order to make filling easier. For this purpose, a movable loading frame is provided outside the enclosure 1 (loading frame not visible in the figures) that is provided with a rail that can be brought into line with the top rail 16 so as to enable the module 5 to be fully extracted from the enclosure 1. The containers 13 are extracted from the slideways 8 of the module 5 suspended from the loading frame and they are loaded with products for dehydrating. The gasket-carrier frame 30 is put back into place on each container 13 which is then put back between the slideways 8. The containers 13 are then in the separation position.

The module 5 is then inserted into the enclosure 1 by causing it to slide on the top rail 16 while it is in its high position so that a container 13 extends beneath each shelf 20. The door 3 is then closed.

The actuators 17 are then caused to move the top rail 16 into its low position. The containers 13 then engage the shelves 20 and come to rest thereon, and the cassettes 9 are brought into contact with the sealing gasket 32. The containers are then in a contact position relative to the cassette 9. In the contact position, it should be observed that a fraction of the weight of the cassette 9 is carried by the slideways 8 via the springs 12 and therefore does not bear on the container 13 and thus does not bear on the corresponding shelf 20 either.

The door 3 is then closed and the suction pump of the evacuation means 4 is set into operation.

Air is then sucked out from the enclosure 1. Air escapes from the containers 13 through the top openings 25 thereof and through the bottom grids of the cassettes 9 before passing through the zeolites so as to flow into the space between the cassettes 9, the shelves 20, and the enclosure 1. The sealing gasket 31 is held between the bottom of the cassette 9 and the rim 14 extending laterally outwards from the edge 26 of the opening 25.

The air is evacuated from the enclosure by the pump of the evacuation means 4.

As the pressure inside the enclosure 1 decreases, the water contained in the products evaporates. The water vapor as created in this way follows the same path as the air until it reaches the zeolites, with the water vapor then becoming trapped in the pores thereof.

The products are thus dehydrated progressively.

It should be observed that the air from the container is sucked through the zeolites such that most of the aromas cannot escape from the container 13, the zeolites limiting their passage to the outside of the container 13 like a molecular sieve. Since these zeolites are very close to the products, the aromas are thus maintained close to the products.

The shelves 20 are heated to prevent the products from freezing under the effect of dehydration and of the reduction in pressure inside the enclosure 1. It is also possible to take advantage of the exothermic nature of adsorption to heat the products or at least to take account thereof in regulating the temperature to which the shelves 20 are heated. Adsorbing water generates an effect of raising the temperature of the zeolites. The heat given off by the zeolites in the cassettes 9 is communicated in part to the products by radiation and by conduction via the slideways 8 and the containers 13. The thermally-insulating material used for the sealing gasket 32 serves to provide better control over this supply of heat and to avoid the products being heated excessively.

The heating of the products also enables water evaporation to be increased. This heating is controlled by means of a temperature regulator member as a function of information supplied by temperature sensors (not shown) that are disseminated within the module 5. By way of example, the temperature sensors comprise temperature probes that pass through a fraction of the cassettes so as to have a sensitive end projecting into the container and an opposite end projecting into the cassette and electrically connected to the regulator member. For this purpose, each cassette has two orifices for passing a temperature probe, at least one of which orifices is provided with a sealing gasket. In a variant, the temperature probe may pass through the wall of the container.

It is also possible to use the temperature regulator member to maintain a temperature difference between the products and the immediate surroundings thereof. For example, a temperature of 20° C. may be maintained for the products and a temperature of 70° C. for their surroundings. This temperature difference causes aromas that are held in the compartments to condense on the products.

It should be observed that the installation is extremely simple to fabricate. Since one cassette is associated with one container and one shelf, the capacity of the installation depends on the number of cassettes, containers, and shelves. An installation of greater capacity can be obtained simply by joining together two enclosures one behind the other and using a plurality of support modules. As a result it is possible to produce installations of greater capacity derived directly from the installation described.

Naturally, the invention is not limited to the embodiment described and variant embodiments can be provided without going beyond the ambit of the invention as defined by the claims.

In particular, the installation may be of a shape different from that described. The cassettes may be fastened in the enclosure 1, as can the support module, in particular when the installation is an installation of relatively small capacity.

The module may have some other number of containers.

The shelves need not be associated with heater means.

The vertical movement of the containers relative to the cassettes may be obtained by using dedicated actuators installed on the modules or secured to the enclosure, acting directly on the containers and/or the cassettes, independently of any association with sealing gaskets.

The sealing gasket may be directly engaged or overmolded on a peripheral edge of the product container or on a rim of the cassette.

The grids of the cassettes 9 may be replaced by any structure (e.g. knitted or woven fabric) or any material that is permeable to air and to water.

What is claimed is:

1. An installation for dehydrating products, the installation comprising an enclosure, a member for sucking out the air contained in the enclosure, a container for products that is received inside the enclosure and that is provided with a top opening having an air- and water-permeable bottom of a cassette extending in register therewith, the cassette containing moisture-adsorption means, wherein a sealing gasket extends between a perimeter of the bottom of the cassette and an edge of the container defining the opening, wherein the installation includes means for moving the cassette and the container relative to each other between a contact position where the sealing gasket is in contact with both the cassette and the edge of the container, and a separation position where the sealing gasket is separated from the cassette and/or the edge of the container, and wherein the enclosure contains at least one shelf, the container and the cassette have lateral portions received in slideways of a support, the cassette being suspended under a top flange of the slideways and the container being movable between the contact position and the separation position in which the lateral portions of the container rest on bottom flanges of the slideways.

2. The installation according to claim 1, wherein the sealing gasket is secured to a removable frame having surfaces for positioning it laterally on the container and/or the cassette.

3. The installation according to claim 2, wherein the frame has a top peripheral rim to which the lateral positioning surfaces belong.

4. The installation according to claim 2, wherein the frame includes a bottom peripheral rim to which the lateral positioning surfaces belong.

5. The installation according to claim 1, wherein the sealing gasket is made of a thermally-insulating material.

6. The installation according to claim 1, wherein the support is movable between a high position in which the container is separated from the shelf and rests via its lateral portions on the bottom flanges of the slideways, and a low position in which the container rests on the shelf and is in the contact position relative to the cassette.

7. The installation according to claim 6, wherein the lateral portions of the cassette are suspended from the top flanges of the slideways by a resilient member.

8. The installation according to claim 7, wherein the support is suspended from a substantially horizontal top rail connected to a ceiling of the enclosure via at least one vertical movement member for moving the top rail between the high position and the low position.

9. The installation according to claim 6, wherein the shelf is associated with heater means.

10. The installation according to claim 6, wherein the enclosure contains a plurality of superposed shelves and the support is fitted with a plurality of superposed slideways.

11. The installation according to claim 10, wherein the support includes a central strength member having a top end secured to a carriage slidable along a the top rail, the slideways extending laterally, projecting from two mutually-opposite faces of the central strength member that are substantially parallel to the top rail, the shelves being disposed in two groups placed facing each other on opposite sides of a path for passing the central strength member of the support.

12. The installation according to claim 11, wherein the central strength member of the support has a bottom end arranged to co-operate with a bottom rail fastened in the enclosure parallel to the top rail.

* * * * *